US005971640A

United States Patent [19]

Brewington et al.

[11] Patent Number: 5,971,640

[45] Date of Patent: Oct. 26, 1999

[54] METHOD FOR CUTTING PAPER IN A PRINTER USING A GEAR WITH A FRICTION PAD

[75] Inventors: James Gabriel Brewington; Richard Hunter Harris; Jeff David Thomas; Kevin Hunter Vorhees, all of Raleigh, N.C.

[73] Assignee: International Business Machines Corporation, Armonk, N.Y.

[21] Appl. No.: 09/170,421

[22] Filed: Oct. 13, 1998

Related U.S. Application Data

[62] Division of application No. 08/919,749, Aug. 28, 1997.

[51] Int. Cl.[6] ..... B41J 11/70

[52] U.S. Cl. ..... 400/621; 83/13; 83/603

[58] Field of Search ..... 400/621; 83/601, 83/602, 603, 13

[56] References Cited

U.S. PATENT DOCUMENTS

| | | | |
|---|---|---|---|
| 3,911,757 | 10/1975 | Rix et al. | 74/437 |
| 4,347,919 | 9/1982 | Maeda | 192/33 R |
| 4,541,468 | 9/1985 | Anderson | 160/177 |
| 4,544,293 | 10/1985 | Cranston et al. | 400/320 |
| 4,810,110 | 3/1989 | Myers | 400/56 |

FOREIGN PATENT DOCUMENTS

| | | |
|---|---|---|
| 348517 | 2/1922 | Germany . |
| 910859 | 5/1954 | Germany . |
| 1-241211 | 9/1989 | Japan . |
| 2-304242 | 12/1990 | Japan . |
| 3-103716 | 4/1991 | Japan . |
| 3-161368 | 7/1991 | Japan . |
| 4-73172 | 3/1992 | Japan . |
| 4-300445 | 10/1992 | Japan . |
| 6-257538 | 9/1994 | Japan . |
| 8-108589 | 4/1996 | Japan . |
| 8-226517 | 9/1996 | Japan . |

OTHER PUBLICATIONS

"Drive Clutch", *IBM Technical Disclosure Bulletin,* vol. 26 No. 9, Feb. 1984, pp. 4573–4574.

*Primary Examiner*—Ren Yan
*Assistant Examiner*—Daniel J. Colilla
*Attorney, Agent, or Firm*—John D. Flynn; Winstead, Sechrest & Minick, PC

[57] ABSTRACT

A gear drive system for a printer designed to print upon a continuous roll of paper and having a blade used to cut off printed portions of paper from the paper roll is implemented. The gear drive system has a drive gear which slips against a toothless portion of a driven gear while paper is being fed through the printer for printing by a print head. When printing stops, the drive gear reverses its rotation, causing the driven gear to engage the drive gear. A cutter blade is controlled by the driven gear, with the blade cutting off the paper as the drive gear is in reverse rotation. After the paper is cut, the drive gear resumes its forward rotation, rotating the blade away from the paper. After the blade has been rotated, the drive gear continues to turn, but slips on the toothless portion of the driven gear. Friction losses are minimized as the energy lost as friction is low and full torque is applied to both cutting and opening rotations of the cutter blade.

4 Claims, 4 Drawing Sheets

METHOD FOR CUTTING PAPER IN A PRINTER USING A GEAR WITH A FRICTION PAD

This a division of U.S. Application Ser. No. 08/919,749 filed Aug. 28, 1997.

TECHNICAL FIELD

The invention relates in general to printers having geared drive systems, and in particular to geared drive systems that feed paper through a printer and operate a cutter blade.

BACKGROUND INFORMATION

Printers may be classified as single-sheet printers or continuous-roll printers. Single sheet printers include drive and handling means to advance one sheet of paper at a time past a print head so that characters may be printed thereon. As each sheet is printed, it is ejected to be received by the user. Continuous-roll printers include a roll of paper instead of a supply of single sheets of paper. As the roll of paper is unrolled, the end of the paper is advanced past the print head by feed rollers or other drive mechanism for printing. After a printing job is completed, a blade or knife cuts the printed paper or the paper is detached manually using a tear bar. Common continuous-roll printers include thermal paper fax machines and retail checkout registers.

It is common to use a geared drive system in a continuous-roll printer with a stepper motor as a power source. Typically, a stepper motor will turn a fixed number of degrees in response to a pulse of electricity or a command from a controller. Gears are used to connect the stepper motor to the drive mechanism to ensure that a fixed rotation translates to a fixed advancement of the paper from the paper roll. It should be noted that the use of a stepper motor is not required, as other power sources may be used to control the rotation of the drive source and the feed rollers to accurately position the paper in relation to the print head for precise printing.

When the stepper motor turns in the forward direction in a continuous-roll printer, the paper is unwound from the paper roll and advanced past the print head. Turning the stepper motor in the reverse direction engages the knife or cutter blade to cut the printed paper from the roll. Using the same motor for feeding paper through the printer and cutting the printed paper is economical.

Continuous-roll printers are designed to only print in the forward direction. The paper is not retracted or wound back onto the paper roll during or after printing. With a direct gear system, reversing the stepper motor results in reverse feeding of the paper. Therefore the stepper motor, when turning in reverse, decouples from the paper drive system as it engages the cutter mechanism.

A wrap spring slip clutch, hereinafter referred to as a slip clutch, with an overrunning torque connects the gear drive system and the cutter blade. Slip clutches are used to transmit power in one direction of rotation only (called the "locking rotation") and include teeth, ratchet or spring mechanisms that lock a driven part to a driving part when the driven part is turned in the locking direction. When the rotation of the driving part is reversed, the mechanism releases, causing the driven part to stop turning while the driving part continues to turn, or "overrun" the driven part.

Some slip clutches are designed with an "overrunning torque" or a mechanism that will not automatically release during reverse rotation. A slip clutch with an overrunning torque will transmit torque from the driven part to the driving part even in the reverse direction, but will slip if the torque required to drive the driven part exceeds the overrunning torque.

As an example, consider a slip clutch with an overrunning torque of 1 inch-ounce. This slip clutch will lock if driven in its locking rotation, transmitting rotation of the driving part to the driven part without slippage. In the reverse rotation, the clutch will slip if the load on the driven part exceeds 1 inch-ounce. Causing the clutch to slip, however, requires an amount of torque equal to the overrunning torque as a friction loss. In other words, a drive motor generating 10 inch-ounces of torque in the reverse direction through a clutch that is slipping wastes 1 inch-ounce of torque that are required to cause the clutch to slip. The effective torque of the motor is thereby reduced to 9 inch-ounces.

The slip clutch is configured so that a reverse rotation of the stepper motor causes a locking, or forward rotation of the slip clutch. When the stepper motor and gear drive are driven in reverse, the slip clutch locks, engaging the cutter blade to slice off a piece of paper. Afterwards, the stepper motor resumes its forward rotation, causing the slip clutch to turn in reverse. The clutch, however, will not release until the torque required to continue turning the driven part exceeds the overrunning torque. Therefore, the cutter blade will be lifted, as slip clutches are designed to have an overrunning torque greater than the torque required to lift the cutting blade out of the paper path. The cutter blade continues to lift until it reaches a stop or limit mechanism, preventing further rotation, greatly increasing the torque required to lift the blade, and causing the slip clutch to release.

Even after the blade is lifted and the clutch released the stepper motor must continue to expend energy overcoming the overrunning torque so the blade will not fall back into the paper path. This results in friction loss, is a waste of energy, and increases the cost of the printer because a larger stepper motor must be specified than is required to drive paper through the paper path for printing. Additionally, it is rare that a slip clutch has a constant overrunning torque during its lifetime because environmental conditions, wear, and age modify the behavior of the clutch over time. If the overrunning torque becomes too high, paper will not feed properly because too much of the stepper motor's torque is wasted overcoming the friction generated by the overrunning torque. If the overrunning torque becomes too low, the cutter blade will not open or may slip back down into the paper path during printing.

What is needed, therefore, is a device to allow a cutter blade to engage upon reverse rotation of the stepper motor, to disengage upon the consequent forward rotation of the stepper motor, and to maintain its position out of the paper path during printing without adding the friction associated with an overrunning-style slip clutch to the system.

SUMMARY OF THE INVENTION

The previously mentioned needs are fulfilled with the present invention. Accordingly, there is provided, in a first form, a gear drive system including a drive gear having gear teeth around its entire perimeter, a driven gear having a section of gear teeth for meshing with the drive gear, a section of starter gear teeth for initially meshing with the drive gear, and a cantilevered section without gear teeth upon which the drive gear slips when the drive gear turns in one direction and upon which the drive gear urges the starter teeth, then the gear teeth of the driven gear, into engagement when the drive gear turns in the other direction.

These and other features, and advantages, will be more clearly understood from the following detailed description taken in conjunction with the accompanying drawings. It is important to note the drawings are not intended to represent the only form of the invention.

BRIEF DESCRIPTION OF THE DRAWINGS

For a more complete understanding of the present invention, and the advantages thereof, reference is now made to the following descriptions taken in conjunction with the accompanying drawings, in which.

DETAILED DESCRIPTION

The principles of the present invention and their advantages are best understood by referring to the illustrated embodiment depicted in FIGS. 1–4 of the drawings, in which like numbers designate like parts. In the following description, well-known elements are presented without detailed description in order not to obscure the present invention in unnecessary detail. For the most part, details unnecessary to obtain a complete understanding of the present invention have been omitted inasmuch as such details are within the skills of persons of ordinary skill in the relevant art. Details regarding control circuitry or mechanisms used to control the rotation of the various elements described herein are omitted, as such control circuits are within the skills of persons of ordinary skill in the relevant art.

Figure 1:
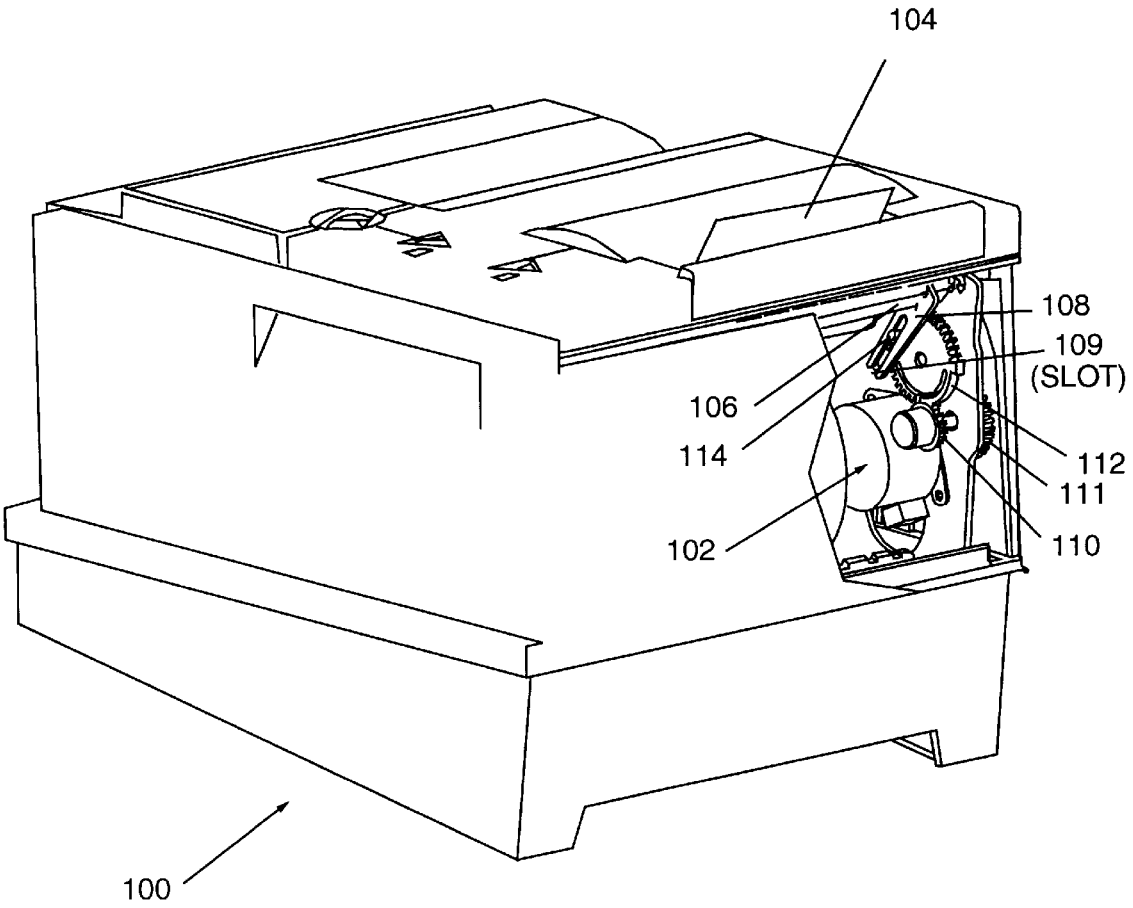
FIG. 1 is a perspective view of a printer incorporating one embodiment of the present invention.

Turning now to FIG. 1, a printer 100 is illustrated incorporating one embodiment of the present invention. A portion of the wall of printer 100 has been removed to illustrate interior detail and a portion of the elements of the present invention. Printer 100 comprises drive motor 102 which is used to feed paper 104 from a paper roll (not illustrated) along a paper path (not illustrated) for printing by a print head (not illustrated). The paper roll is stored inside printer 100. The portion of paper visible in FIG. 1 has been printed and cut off by cutter blade 106. Cutter blade 106 is attached to cutter blade bracket 108. Cutter blade bracket 108 comprises a slot 109. Rotation and torque from motor 102 is transmitted by gearing 111 (only a portion of gearing 111 is visible) to drive gear 110. Drive gear 110 engages clutchless gear 112. Pin 114 is carried by clutchless gear 112. Pin 114 extends from clutchless gear 112 at a point near clutchless gear 112's perimeter. Pin 114 engages slot 109, so that rotation of clutchless gear 112 causes pin 114 to rotate cutter blade bracket 108, such that cutter blade 106 rotates a cut edge (not illustrated) across the paper path in a cutting motion.

Drive motor 102 is preferably a stepper motor, although any power source that provides a controlled rotation may be used.

Printer 100 in FIG. 1 is only one embodiment of the present invention. Other embodiments may include fax machines using thermal paper, a printer that uses a knife or cutter blade to cut a printed portion of paper away from a roll of paper, and the like.

Figure 2B:
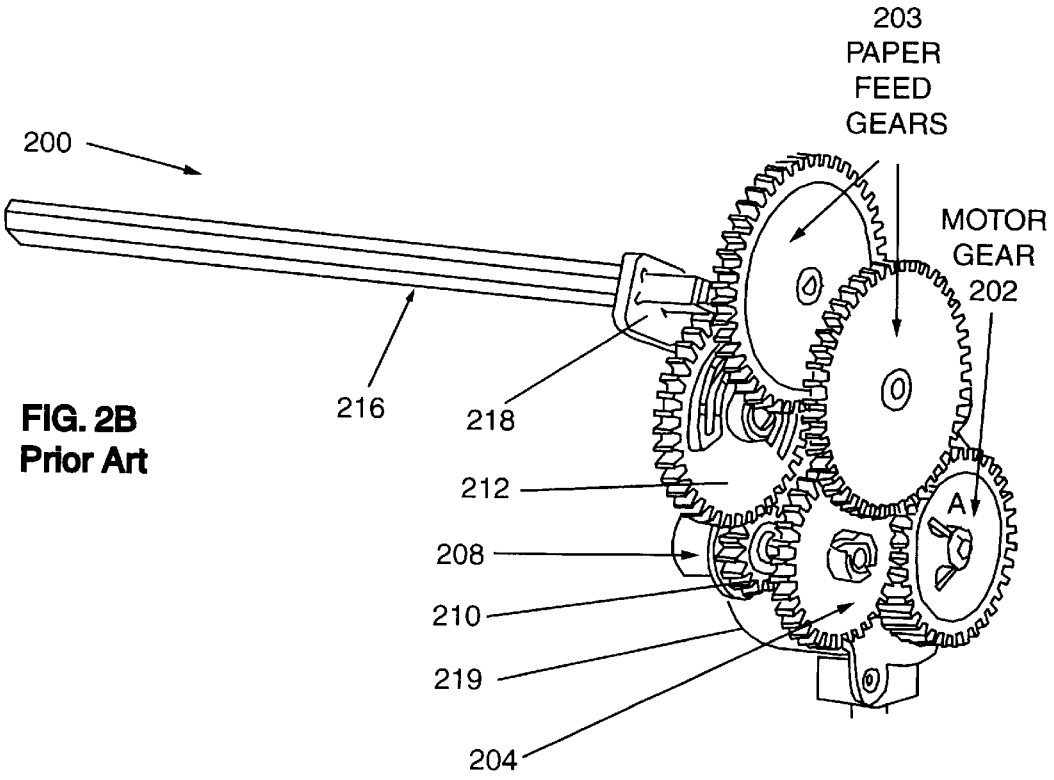
FIG. 2B Prior Art
FIG. 2B is a perspective view of a gear drive mechanism in accordance with the prior art pointer disclosed in FIG. 2A.
Figure 2A:
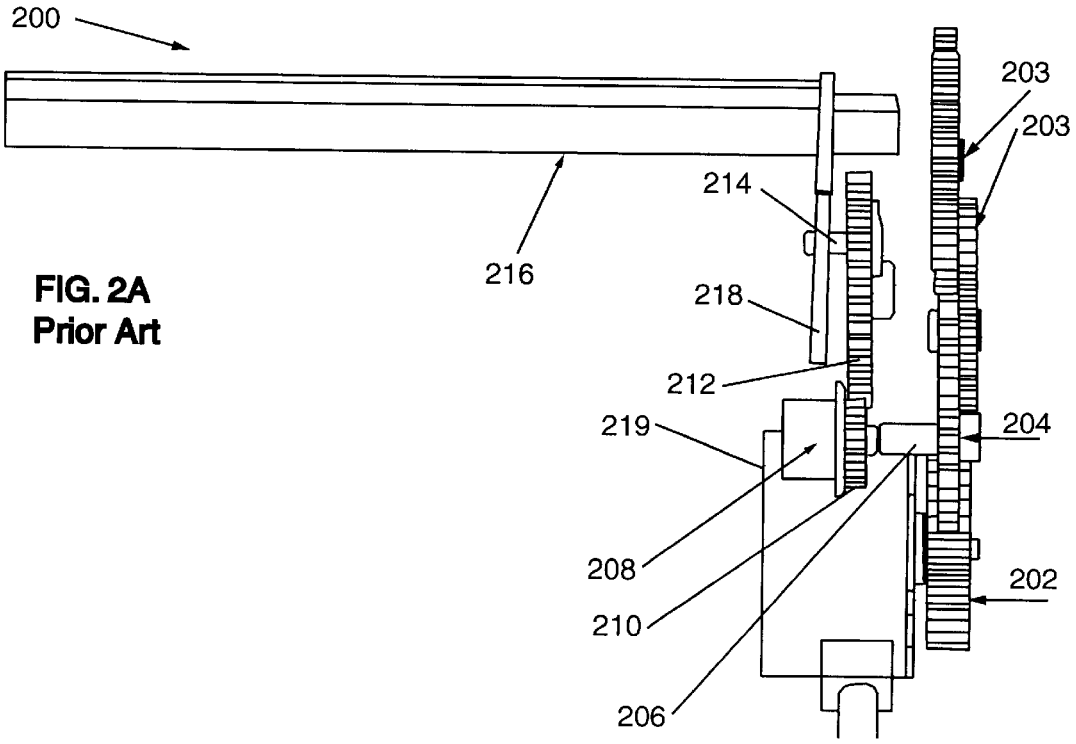
FIG. 2A Prior Art
FIG. 2A is a rear view of a gear drive mechanism in accordance with a prior art printer.

FIGS. 2A and 2B are a rear view and a perspective view of prior art gear drive system 200. Motor gear 202 is driven by a stepper motor 219 or other power source. Motor gear 202 meshes with paper feed gears 203. Paper feed gears 203 drive feed rollers or another mechanism (not illustrated) to feed paper from a roll of paper through a paper path and past a print head for printing. Clutch gear 204 is also driven by motor gear 202. Clutch gear 204 transmits power through shaft 206 to slip clutch 208. The output, or drive portion, of slip clutch 208 is attached to slip clutch gear 210. Slip clutch gear 210 drives cutter blade gear 212. Carried by cutter blade gear 212 is pin 214 which extends from cutter blade gear 212 at a point near cutter blade 212's perimeter.

Also illustrated in FIGS. 2A and 2B are cutter blade 216 and cutter blade lever 218. Cutter blade lever 218 is attached to one end of cutter blade 216. Cutter blade lever 218 has a slot (not illustrated) into which pin 214 extends. As cutter blade gear 212 rotates, pin 214 causes cutter blade lever 218 to rotate and cutter blade 216 to move across the paper in a cutting motion.

Slip clutch 208 is configured so that its locking rotation is counterclockwise when viewed in FIG. 2B. When motor gear 202 is driven clockwise, clutch gear 204 and shaft 206 turn in a counterclockwise direction. This locks slip clutch 208, causing slip clutch gear 210 to turn counterclockwise. The counterclockwise motion of slip clutch gear 210 causes a clockwise rotation of cutter blade gear 212. As cutter blade gear 212 rotates clockwise, pin 214 follows, rotating cutter blade 216 clockwise into the paper path to cut the paper.

After the paper is cut, the stepper motor or other drive source reverses rotation, which in turn reverses clutch gear 204 and shaft 206 to a clockwise direction. Slip clutch 208 is configured with an overrunning torque higher than the torque required to "unwind" cutter blade gear 212 and rotate cutter blade 216 counter-clockwise out of the paper path. Cutter blade 216's counter-clockwise rotation is limited, however, by a stop or other limit device (not illustrated). Once cutter blade 216 reaches its limit of rotation, further rotation of cutter blade gear 212 and slip clutch gear 210 is impeded, however clutch gear 204 and shaft 206 continue to rotate, causing slip clutch 208 to unlock.

The disadvantages presented by this arrangement are many. First, slip clutch 208 must be designed with an amount of overrunning torque so cutter blade 216 will open in response to the "backwards" (counterclockwise) rotation of cutter blade gear 212. Additionally, slip clutch 208 must be designed with overrunning torque so cutter blade 216 will not fall back into the paper path during printing or paper feeding. This overrunning torque acts as a drag on the motor or power source. The energy of the motor is ideally used to feed paper through the printer, and increasing the size of the motor to overcome the overrunning torque of slip clutch 208 results in a waste of energy. Second, as the slip clutch wears, the overrunning torque may decrease, which lessens the load on the motor, but tends to allow cutter blade 216 to fail to open. Finally, the overrunning torque may increase over time, which will increase the load on the motor, decreasing the motor's ability to feed paper through the printer.

Figure 4:
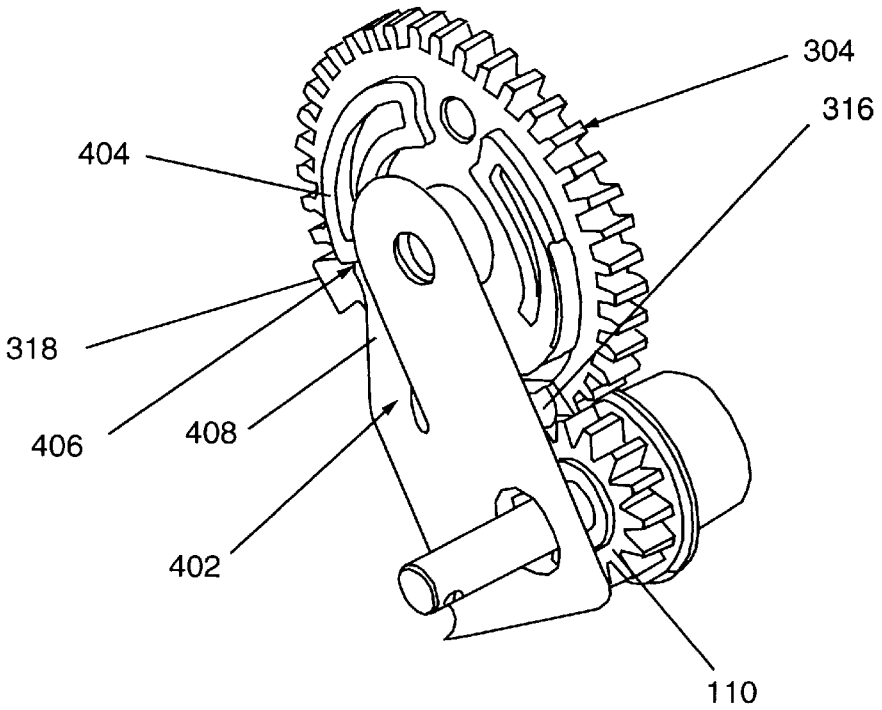
FIG. 4 is a perspective view of the clutchless gear feature of one embodiment of the present invention.
Figure 3:
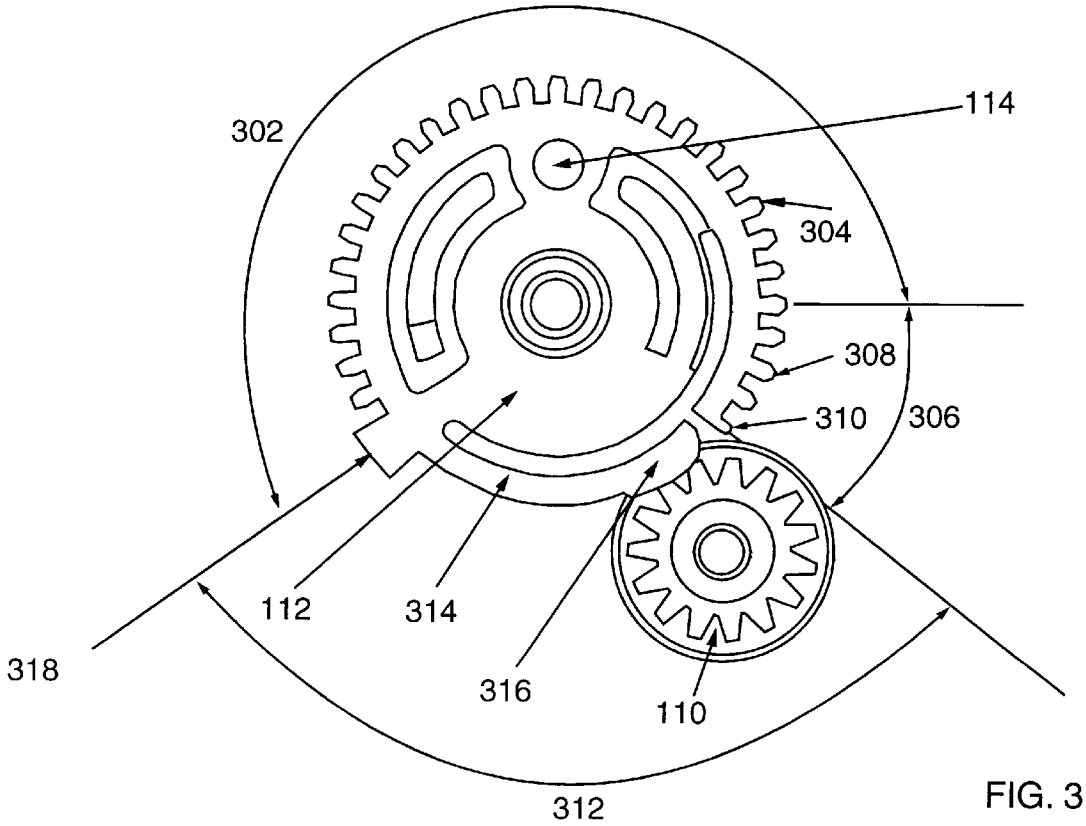
FIG. 3 is a side view of the clutchless gear feature of one embodiment of the present invention.

Turning now to FIGS. 3 and 4, a side view and a perspective view of one embodiment of the present invention are illustrated. The apparatus illustrated in FIGS. 3 and 4 is intended to replace slip clutch 208 and cutter blade gear 212 of FIGS. 2A and 2B to overcome the disadvantages presented by the prior art. The apparatus in FIGS. 3 and 4 is also illustrated in FIG. 1 as installed in printer 100.

A perimeter of clutchless gear 112 is divided into three sections, 302, 306 and 312. First section 302 is comprised of gear teeth 304, which are nonelastic and sized and spaced to mesh with the teeth of drive gear 110. The teeth of drive gear 110 are also nonelastic.

Second section 306 has starter teeth 308. Starter teeth 308 are nonelastic and have the same spacing, or pitch, as gear teeth 304 but are shorter in height than gear teeth 304 to facilitate meshing between drive gear 110 and clutchless gear 112. All of starter teeth 308 are shorter in height than gear teeth 304, however first starter tooth 310 is the shortest, with each successively counterclockwise starter tooth 308 taller than a preceding starter tooth 308. Starter teeth 308 are supported on a cantilever section attached to clutchless gear 112 near the transition between sections 306 and 302.

Third section 312 of clutchless gear 112 does not have gear teeth but is provided with a cantilevered perimeter arm 314. Cantilevered perimeter arm 314 is attached at one end, adjacent first section 302 and extends along the perimeter of clutchless gear 112 towards second section 306. The free end of cantilevered perimeter arm 314 comprises a friction pad 316. Clutchless gear 112 may be provided with stop tooth 318 to limit the rotation of clutchless gear 112.

In FIG. 4, a limit spring 402 is illustrated. Limit spring 402 is only partially illustrated in FIG. 3 for clarity. Clutchless gear 112 has raised portion 404 and stop face 406. Stop face 406 is substantially perpendicular to clutchless gear 112. Limit spring 402 has stop arm 408 which contacts stop face 406 to prevent further counterclockwise rotation of clutchless gear 112.

In FIG. 3, clockwise rotation of drive gear 110 corresponds to normal printing and paper feeding of printer 100. Clockwise rotation of drive gear 110 tends to drive clutchless gear 112 counterclockwise. Stop face 406 and stop arm 408 are configured so that the teeth of drive gear 110 slip against friction pad 316 at clutchless gear 212's counterclockwise limit of rotation. Friction between friction pad 316 and drive gear 110 impose enough torque to hold cutter blade 216 open. When printing is completed and the paper is to be cut by cutter blade 106, drive motor 102 (FIG. 1) reverses, causing drive gear 110 to turn counterclockwise. As clutchless gear 112 turns clockwise in response to reversed friction force between drive gear 110 and friction pad 316, the teeth of drive gear 110 engage starter teeth 308, beginning with first tooth 310. Because starter teeth 308 are shorter than gear teeth 304, the gears tend to mesh easily without binding or locking. Bending or locking is also eliminated because any mismatch between starter teeth 308 and gear teeth 304 will flex the cantilever support to allow the teeth to mesh.

Figure 5:
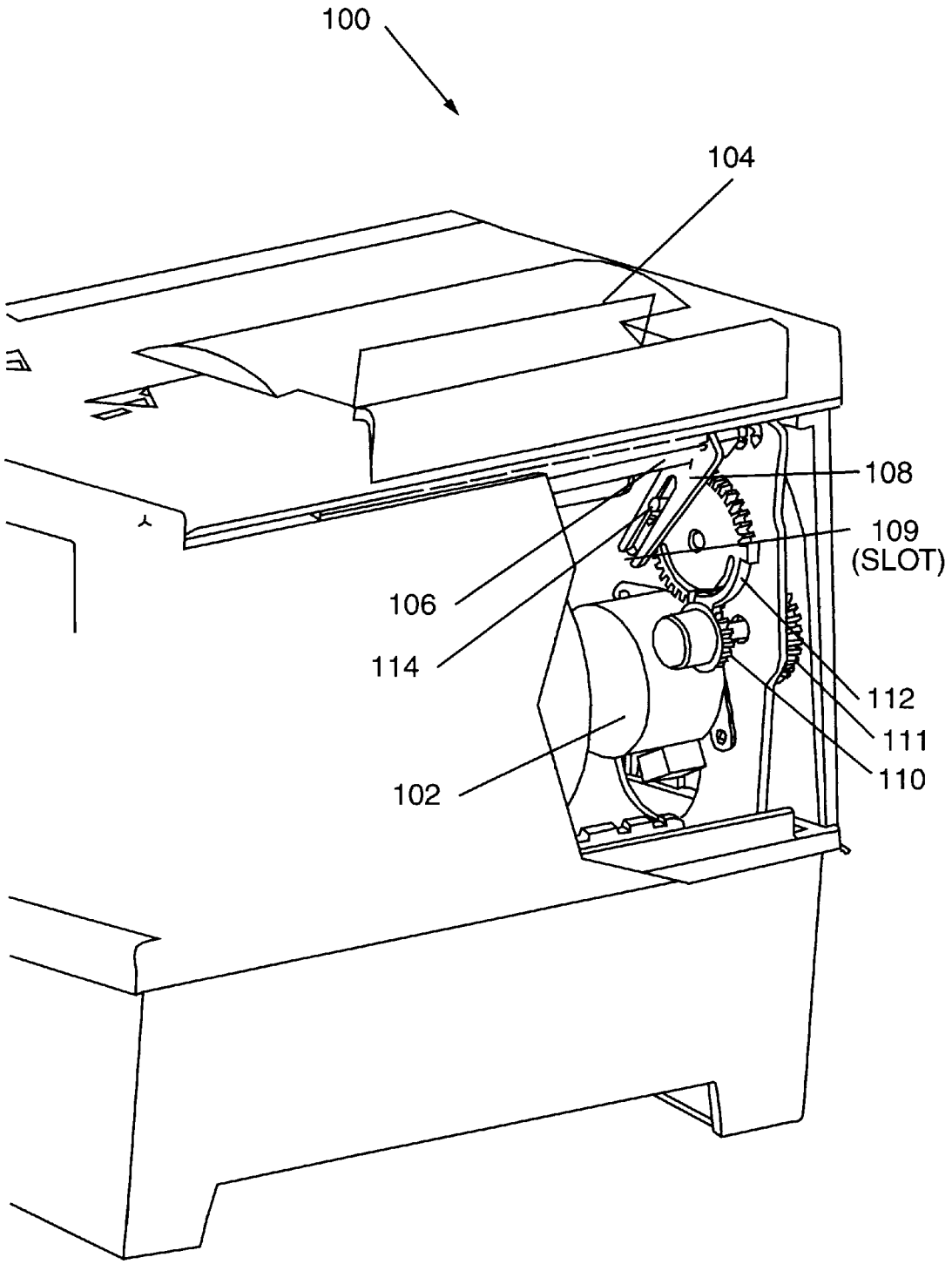
FIG. 5 is an exploded view of the printer of FIG. 1.

Refer now to FIG. 5, which illustrates an exploded view of printer 100. After drive gear 110 and clutchless gear 112 have meshed, clutchless gear 112 is turned clockwise to move pin 114 in slot 109, driving cutter blade lever 108 and cutter blade 106 downward across the paper path in a cutting motion. After the paper has been cut, drive gear 110 returns to its clockwise rotation, causing clutchless gear 112 to follow along in a counterclockwise rotation, opening cutter blade 106 out of the paper path after the paper has been cut. In opening cutter blade 106, clutchwess gear 112 rotates counterclockwise, with each successive gear tooth 304 meshing and unmeshing with drive gear 110.

After clutchless gear 112 has turned past all of gear teeth 304 and starter teeth 308, drive gear 110 contacts friction pad 316 as stop face 406 comes to rest against stop arm 408. Drive gear 110 continues to turn clockwise, slipping against friction pad 316. The resistance of drive gear 110 slipping on friction pad 316 is less than the overrunning torque of slip clutch 208, therefore less of drive motor 102's energy is lost. Additionally, clockwise rotational slipping of clutchless gear 112 (which would tend to close cutting blade 106) will be prevented by the clockwise rotation of drive gear I 10 as it slips against friction pad 316. Unlike the arrangements of the prior art illustrated in FIGS. 2A and 2B, wherein the torque to open blade 216 is limited by the slip torque of slip clutch 208, all the available torque from drive gear 110 is applied to open cutting blade 106. Also, the resistance of drive gear 110 slipping on friction pad 316 is less than the overrunning torque of slip clutch 208, therefore less of drive motor 102's energy is lost.

Although the invention has been described with reference to specific embodiments, these descriptions are not meant to be construed in a limiting sense. Various modifications of the disclosed embodiments, as well as alternative embodiments of the invention will become apparent to persons skilled in the art upon reference to the description of the invention. It is therefore, contemplated that the claims will cover any such modifications or embodiments that fall within the true scope of the invention.

What is claimed is:

1. A method for cutting paper in a printer, comprising the steps of:

operating a drive gear in a first direction, causing teeth in the drive gear to mesh with teeth in a driven gear in a first direction, causing teeth in the drive gear in a first direction to thereby cause the cutting blade to cut the paper; and operating the drive gear in a second direction to thereby cause the driven gear to rotate in a second direction thereby causing the cutting blade to be removed from the paper, and subsequent to the cutting blade being removed from the paper, continuing to rotates the driven gear to a position so that the drive gear engages a friction pad on the driven gear.

2. The method as recited in claim 1, further comprising the step of:

continuing to rotate the drive gear in the second direction while maintaining a frictional contact with the friction pad of the driven gear.

3. The method as recited in claim 2, wherein the first operating step further comprises the step of engaging the teeth of the drive gear with teeth of increasing height on the driven gear before meshing the teeth of the drive gear with the teeth of the driven gear.

4. The method as recited in claim 1, further comprising the step of:

stopping the rotation of the driven gear in the first direction with a stop tooth engaging the teeth of the drive gear.

* * * * *